US005938010A

United States Patent [19]

Osterbye

[11] Patent Number: 5,938,010

[45] Date of Patent: Aug. 17, 1999

[54] MULTI-PURPOSE HOLDER DEVICE

[76] Inventor: Don Osterbye, 4987 Glen Castle Dr., Tallahassee, Fla. 32308

[21] Appl. No.: 08/924,373

[22] Filed: Sep. 5, 1997

Related U.S. Application Data

[63] Continuation-in-part of application No. 08/692,755, Aug. 6, 1996, abandoned.

[51] Int. Cl.[6] ..... A45C 15/00

[52] U.S. Cl. ..... 206/38; 206/449; 206/39; 206/39.5

[58] Field of Search ..... 206/38, 39, 39.4, 206/39.5, 357, 355, 449; D3/247

[56] References Cited

U.S. PATENT DOCUMENTS

| | | | |
|---|---|---|---|
| D. 256,552 | 8/1980 | McGahee | D3/56 |
| 501,279 | 7/1893 | Knight | 206/39 |
| 806,985 | 12/1905 | Mallory | 206/39.5 |
| 1,310,407 | 7/1919 | Auld | 206/357 |
| 1,466,729 | 9/1923 | Riley . | |
| 2,185,624 | 1/1940 | Beck | 206/39 |
| 2,776,743 | 1/1957 | Treiss | 206/357 |
| 3,543,918 | 12/1970 | Waterman | 206/357 |
| 4,170,914 | 10/1979 | Carrier | 206/39.5 |
| 4,450,955 | 5/1984 | Featherston | 206/39.6 |
| 5,020,255 | 6/1991 | Rodel | 206/39.5 |
| 5,358,019 | 10/1994 | Sumner, II | 150/147 |
| 5,718,329 | 2/1998 | Ippolito et al. | 206/38 |

*Primary Examiner*—David T. Fidel
*Attorney, Agent, or Firm*—Carnes, Cona & Dixon

[57] ABSTRACT

The present invention is a multi-purpose holding device which will efficiently removably maintain a plurality of cards and simultaneously removably maintains other documents, such as, but not limited to, bank notes, checks, business cards, or the like. The holding device includes an overall rectangular configuration having a base wall. One side of the base wall includes channels for removably receiving cards. A stop means is located on opposite sides of the base wall. These stop means prevent the stored items from accidentally falling therefrom. Secured to the opposite side of the channels is a clip having resilient characteristics.

16 Claims, 2 Drawing Sheets

MULTI-PURPOSE HOLDER DEVICE

This is a continuation-in-part of application Ser. No. 08/692,755 filed Aug. 6, 1996, now abandoned.

BACKGROUND OF THE INVENTION

1. Field of the Invention

The present invention relates generally to a multi-purpose holder device and more particularly to a holder device which is designed and configured to removably house and maintain a plurality of cards, such as credit cards, medical cards, or the like, and simultaneously removably secure paper items, such as bank notes, checks or the like, efficiently and compactly.

2. Description of the Prior Art

Individuals today are constantly searching for devices which will assist in organizing their daily responsibility and even their personal, yet important, documentation. The typical consumer also desires that these particular devices be not only practical but aesthetically pleasing and compact as well. For example, day timers are compact devices which are invaluable to many individuals. These day timers offer the consumer a single device that can assists in a multiplicity of tasks, such as maintaining business cards, receipts, daily scheduling, addresses, phone numbers, and the like.

Yet another storage device used for organization and versatility is the conventional wallet. Wallets have been utilized for several years. The wallet is a conventional item and is universally known. The wallet is a device which can neatly store various cards, bank notes, and even personal photographs, or the like. Though functional, many believe that the wallet is too bulky for carrying in one's pocket and also not as efficient.

Accordingly efforts have been made to provide an efficient means for carrying items which may be used on a regular basis and which are typically found in the wallet. One such device is U.S. Pat. No. Des. 256,552, issued to MaGahee. In this design patent there is shown a credit card holder having a frame-like construction. Two identical mirrored bends, forming channels, are used to receive and maintain the plurality of credit cards or the like. Extending outwardly from the upper or left channel is an extending stop flange. This flange acts as a stop means and is used for securing the card within the channel. Though efficient in maintaining credit cards, this device fails to offer or structurally allow a means of carrying paper products, such as bank notes, checks or the like. Since the back of the device disclosed by McGahee is opened, it is infeasible to attach a money clip or the like thereto, without affecting the structurally integrity of the unit. Additionally, the location of the stop flange provides a device which can be obstructive when inserting cards therein. Thereby, providing a card holder which is difficult to utilize, especially for those with limited dexterity.

Yet another device is disclosed in U.S. Pat. No. 1,466,729 issued to Riley. In this patent there is disclosed a holder comprising a first component which can receive a second component. The components are separate elements and are constructed of material which is foldable, thereby providing a device which is not an integral structure as well as providing a device which is structurally inadequate. In use, the first portion is designed to bend for inherently forming channels. The channels are designed specifically for receiving a ticket. After the ticket is located within the channel, the second portion is inserted therein. Once slidably inserted, the second portion having a tongue will exert a constant pressure on the ticket for providing the ticket to be in a fixed and secured position. This device is design specifically for use with tickets and as such cannot be used for credit cards, money notes or the like. The design and structure of the tongue provides a device which is obstructive and can ruin the credit card by damaging the magnetic strip. Further, the of two components provides a device which difficult to utilize and inefficient for the needs of today's consumers.

Still another device is disclosed in U.S. Pat. No. 4,450,955 issued to Featherston. Featherston teaches a cardholding having an enclosed back wall. Extending outwardly from the parallel outer edges are grooves when are designed and configured to receive credit cards or the like. The channels each have a different thickness for providing for one pocket to act as a holding means for holding the card in a fixed position. The use of the providing the channels with varying thickness provides a device which is difficult to manufacture. Additionally, in time and after daily use, the channels will inherently increase in size, consequently eliminating the capability of the holding means. Thereby, rendering the card useless. Further, Featherston fails to disclose a means of maintaining bank notes and the like. This failure provides a device which is limit in use and versatility.

Still another device is shown in U.S. Pat. No. 5,358,019 issued to Sumner, III. Here there is illustrated a simple, and possibly, an inoperable design for a combined card holder with a money clip. In this patent there is disclosed an enclosed back surface having a money clip attached thereto. Located oppositely from the money clip are parallel and oppositely located channels used for receiving credit cards and the like. The card holder does not disclose a stop means. Hence, it is seen that the cards, once located therein, can easily fall from the channels. Thereby, rendering an inoperable holder.

Accordingly, it is seen that none of these previous efforts, provide the benefits intended with the present invention, such as providing a compact and aesthetically pleasing product which will successfully and efficiently maintain a plurality of cards while simultaneously have the capability of maintaining other flat objects, such as bank notes, checks, business cards or the like. As illustrated, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides a multi-purpose device designed and configured to successfully and efficiently removably maintains a plurality of card, such as, but not limited to, credit cards, medical cards, identification cards, or the like, as well as oppositely and simultaneously removably maintains other documents, such as, but not limited to, bank notes, checks, business cards, or the like.

The holding device includes an overall rectangular configuration having a base wall. Located one side of the base wall is a first section and located on the opposite side of the base wall is a second section.

Extending outwardly from opposite outer edges of the base wall are two substantially identical mirrored vends forming channels. These channels slidably receive items to be stored on the first section. Located on each edge perpendicular to the outer edges are stop means. These stop means are provided for preventing the stored items from accidentally falling therefrom.

Secured to the second section is a clip having resilient characteristics. Surrounding the clip, on the base wall, is an opening. This opening allows the clip to extend from the exterior area of the second portion and pass through the opening to the exterior area of the first portion. Thereby, providing the tip of the clip to be substantially aligned with the outer area of the channels. In this design and configuration, the clip will aid and assist in the maintainability of the items within the channels for providing the clip to friction engage the items stored.

The base, channels, and clip form an integral structure which is structurally sound. The channels, base wall, and stop means surround the cards, and offers and adequate amount of protection and prevents damage therewith. Additionally, due to the structure of the device, the magnetic strip, which is commonly located on various cards, is free from obstruction and damage.

Accordingly, it is the object of the present invention to provide for a multi-purpose holder device which will overcome the deficiencies, shortcomings, and drawbacks of prior holder devices and methods thereof.

Another object of the present invention a multi-purpose holder device which is an integral unit, compact in size and aesthetically pleasing, and which will successfully perform a multitude of tasks.

Still a further object of the present invention, to be specifically enumerated herein, is to provide a multi-purpose holder device in accordance with the preceding objects and which will conform to conventional forms of manufacture, be of simple construction and easy to use so as to provide a device that would be economically feasible, long lasting and relatively trouble free in operation.

Although there have been many inventions related to a holding devices, none of the inventions have become sufficiently compact, low cost, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

With reference to drawings, and in particular to FIGS. 1–9 thereof, the multi-purpose holder device of the present invention will be described. As seen, the multi-purpose holder device 10 is generally rectangular in shape and comprises a base wall 12 having outer edges 14*a* and 14*b* and perpendicular edges 16*a* and 16*b*. These edges are clearly illustrated in FIG. 3.

Figure 3:
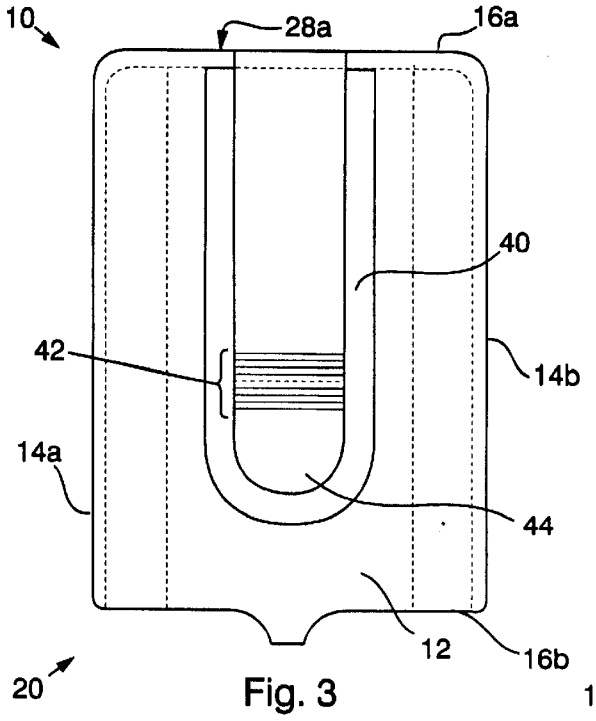
FIG. 3 is a top planar view of the multi-purpose card holder device of the present invention.
Figure 4:
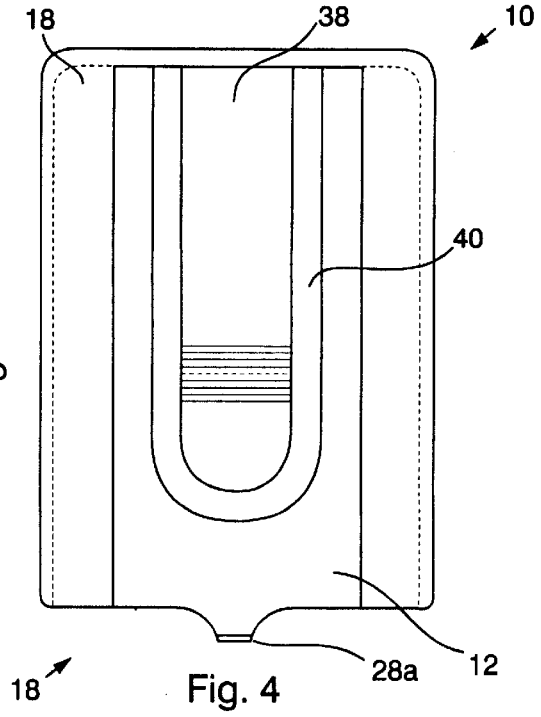
FIG. 4 is a lower planar view of the multi-purpose holder device of the present invention.

The base wall 12 further includes a front or first section 18 (shown in FIGS. 1, 2 and 3) and a rear or second section 20 (shown in FIG. 3). The front or first section includes a means for slidably maintaining cards or the like while the rear or second section includes clipable means for maintaining items.

Figure 1:
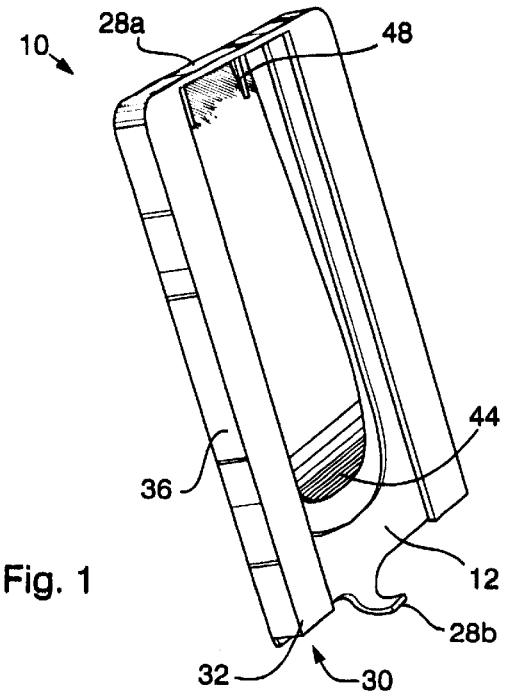
FIG. 1 is a perspective front view of multi-purpose holder device of the present invention.
Figure 2:
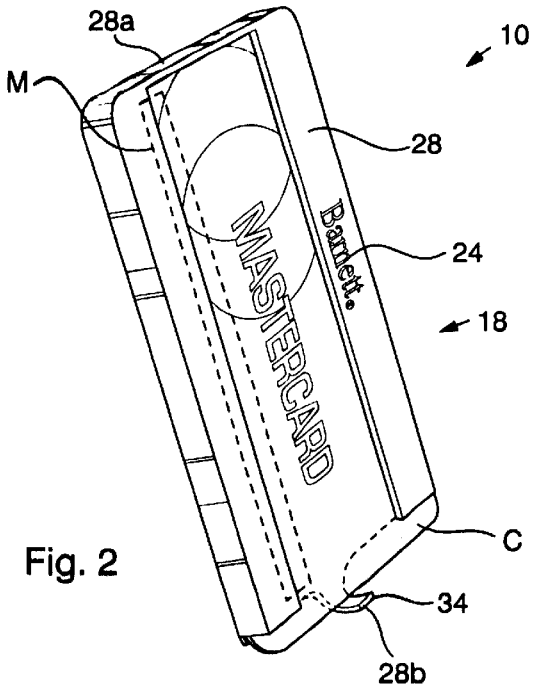
FIG. 2 is a perspective front view of the multi-purpose holder device of the present invention having a card removably secured therein.
Figure 6:
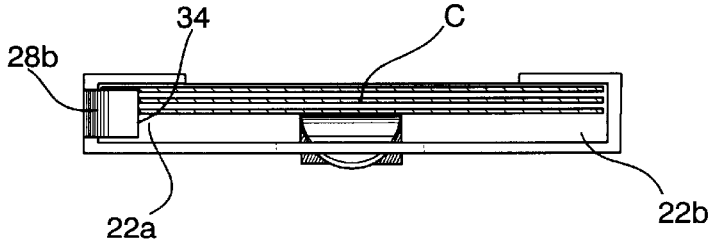
FIG. 6 is a front planar view of the multi-purpose holder device of the present invention, as illustrated in FIG. 5, having conventional cards located therein.

Extending upwardly from each outer edge 14*a* and 14*b*, are to substantially identical mirrored bends forming channels 22*a* and 22*b*, as seen in FIGS. 1 and 6. These channels 22*a* and 22*b*, will slidably receive and maintain the card, such as the card C illustrated in FIG. 2, in a fixed and secured position. A logo 24, advertisement, or the like, can be affixed to the upper wall 26 of the channels. The upper wall 26 of each channel 22*a* and 22*b*, extends towards each other, but do contact one another. This failure to contact provides a means for adequately viewing the cards located within the channels. Thereby, the spacing between the upper wall 26 of the channels is acts as a viewing means for the user.

It is noted that optionally, this viewing means can be eliminated to provide for the upper wall 26 to contact each other and provide for a second wall to be located oppositely and parallel to the base wall.

The upper wall 26 of the channels is also designed and configured so not be obstructive to magnetic strip M (illustrated in outline in FIG. 2), typically located on conventional cards C. Thereby, the upper wall 26 would not terminate in proximity to the area of the magnetic strip. This will prevent the edge of the upper wall from contacting, scratching or destroying the magnetic strip if the card were inserted improperly within the holder device 10. Accordingly, the upper wall 26 will terminate before the magnetic strip or extend pass the magnetic strip.

For preventing the cards from falling from the channels 22*a* and 22*b*, a stop means is located on each perpendicular edge 16*a* and 16*b*. At least one stop means extends partially across one perpendicular edge for allowing an entrance and exit means to exists for rendering the user to easily and successfully insert and remove cards therefrom.

One embodiment of the stop means 28*a* is illustrated in FIGS. 1–9. As shown in these figures, this first stop means is a wall which extends upwardly from and entirely across the perpendicular edge. This wall will prevent cards from slippage.

An alternative embodiment of the stop means 28*b* is illustrated in FIGS. 1–4, 8 and 9. As illustrated in these figures, the stop means 28*b* comprises of an upward curved flange member extending outwardly and upwardly from the perpendicular edge of the base wall 12. This flange can be located along any area of the perpendicular edge. As seen, this stop means 28*b* provides for a clearance 30 to exists between the end of channel 32 and tip or end of the flange 34. This clearance 30 enables the items to be inserted into or removed from the channels quickly and proficiently. The tip 34, which extends upward contacts the edge of the card and prevent it from sliding therefrom.

The second embodiment of the stop means 28*b* can be reposition and reoriented on the perpendicular edge or channel, so long as the tip 34 curves towards the front or first section 18 of the base wall 12 of the device 10.

Figure 5:
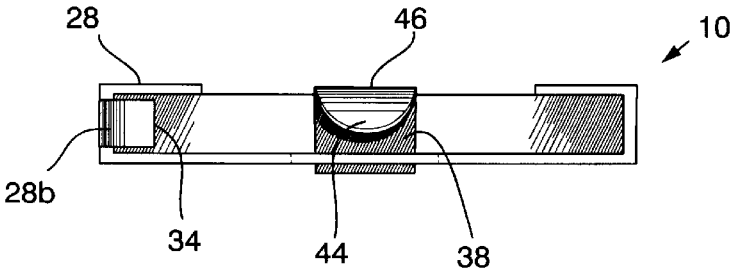
FIG. 5 is a front planar view of the multi-purpose holder device of the present invention illustrating an alternative location for the stop means used with the holder device of the present invention.
Figure 7:
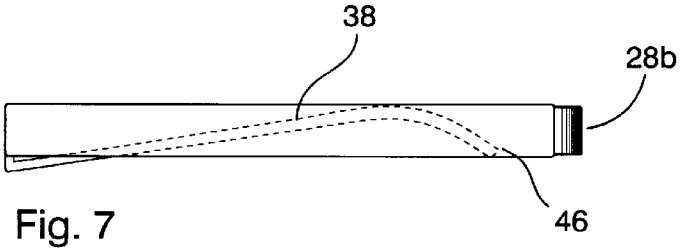
FIG. 7 is a side view of the multi-purpose holder device of the present invention, having a stop means located on a side wall, as illustrated in FIG. 5.
Figure 8:
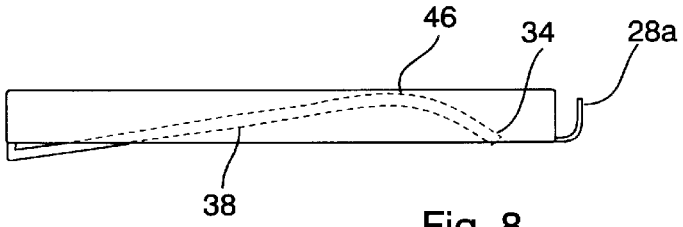
FIG. 8 is a side view of the multi-purpose holder device of the present invention, having a stop means located on base plate, as illustrated in FIG. 1.
Figure 9:
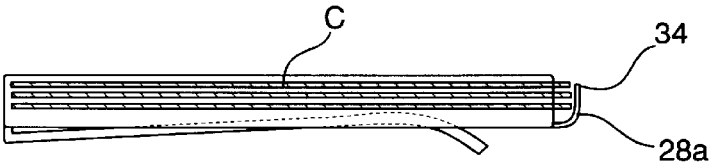
FIG. 9 is a side view of the multi-purpose holder device of the present invention, having a stop means located on base plate, as illustrated in FIG. 1, and having cards located therein.

A reposition and relocation of the second embodiment of the stop means 28*b* is shown in FIGS. 5–7. In these figures, it is illustrated that the stop means 28*b* extends outwardly from the side wall 36 of a channel. Enabling cards to be inserted into the channels provides for the device 10 to be oriented anteriorly. This anterior orientation provides for a lowermost channel and an uppermost channel. Preferably, and as illustrated, for easy accessibility, the stop means, if located on the side wall 36 of a channel, should extend from the lowermost channel. This will prevent any awkwardness which may be associated with locating the stop means at the uppermost channel.

For added versatility of the device 10 of the present invention, a resilient clip 38 is secured to the rear or second portion 20 of the base wall 12. Surrounding the clip 38 and extending through the base wall 12 is an opening 40. The resilient clip 38 encompasses a unique design and configuration. As shown in the figures, the clip is secured to a perpendicular edge of the rear or second portion 20 of the base wall. This clip 38 extend downwardly, from the point of attachment, and through the opening 40. This will provide for the front section 42 of the clip to be located above the front of the base wall 12. The tip 44 of the clip curves slightly downward and towards the rear of the base wall. In this configuration, the highest point 46 or the start of the downward curve will be substantially parallel to the upper wall 26 of the channel.

For added structural integrity and for providing additional support means, gussets 48 can be used. As seen in FIG. 1, the gussets 48 extend from the upper area of the clip to the perpendicular edge of the device.

In order to utilize the device of the present invention, the user slides a card into the channels by way of the clearance means 30. Due to the structure of the stop means, the cards must be inserted one at a time. Once the cards are located therein, the clip may optionally be utilized. This clip can be used for clipping the device 10 to a day timer, folder, belt, or the like. Optionally, this clip can be used for receiving additional items, such as bank notes, checks or the like.

EXAMPLE

The following example is a typical product which has been fabricated to produce favorable and successful results. The product fabricated is illustrated in FIGS. 5–7.

| Component | Size |
|---|---|
| Length and Width of the Base Wall (12) | 2¼ in. by 3¼ in. |
| Height of Side wall (36) of the Channel | ⅜ in. |
| Width of Upper Wall (26) of Channel | ¼ in. |
| Height of curved Stop Means (28b) | ¼ in. |
| Length of clearance (30) from the front of the channel to the tip of the stop means | 3/16 in. |
| Height of the back wall which acts as a stop means (28a) | 5/16 in. |
| Length of resilient clip (38) | 2⅜ in. |
| Width of opening (40) extending along the length of the clip | ¼ in. |
| Width of Opening (4) extending in front of the clip | ⅜ in. |
| Distance from the highest point (46) on the resilient clip (38) to the base plate (12) | ¼ in. |

A plurality of device, having the specifications as identified above were fabricated by way of a mold to produce a final product made of plastic. The products were light weight and aesthetically pleasing. Holding the product frontward (front of base plate facing the user), the second stop means extended outward from the lower channel.

It was observed that the location of the stop means was non-obstructive and allowed conventional credit cards to be easily inserted into the channels. The stop means maintained the cards in a fixed position, even when the device was throw, tossed and placed in a washer and dryer.

The cards were inserted one-at-a-time by placing the edge of each card into the clearance area (30) and pushing the card conveniently into the channels. Once located therein the cards can be viewed. For viewing the cards, the user press downward on the rear of the cards. This will force the front of the cards to extend through and above the clearance, inherently causing the cards to pass above the second stop means 28*b*. Using their thumb, the user can view the cards by moving the upper most card away from the rear of the device, for exposing and viewing the lower or subsequent card. The process of pushing the preceding card for exposing the subsequent card is continued as desired by the user. The user can remove the desired card by grabbing the edge which extends pass the second stop means. The other cards are pushed into the channels to provide for the cards to be located between the first and second stop means.

It was discovered that the resilient clip acted as a retention spring against the cards located within the channel. This provide for the cards to be held frictionally within the channels. The device work well with one card as well as when utilizing a plurality of cards. Monetary bills were placed within the channel and remained securely therein.

The clip was used to secure the device to a conventional check book. The clip successfully maintained the device to the check book. The clip was then used to maintain monetary bills. It's performance was a success.

In summary, the devices which were tested proved to work favorably. The users thoroughly enjoyed the products and tailored its uses to their particular needs. The structure and location of the resilient clip proved to be versatile by allowing the consumer to utilized it to their particular needs. The base wall 12 allowed money to be stored within the channels.

Other variants may be added to the present invention for increasing its versatility and increasing options for the consumer. These variants can include, but are not limited to, key ring, miniature flash lights, or the like.

While the invention has been particularly shown and described with reference to an embodiment thereof, it will be understood by those skilled in the art that various changes in form and detail may be made without departing from the spirit and scope of the invention.

I claim:

1. A multi-purpose holder device comprising:

a base wall having a front, rear, parallel side edges, and parallel perpendicular edges;

said perpendicular edges are perpendicular to said side edges;

a channel extends upwardly and outwardly from said front and from each parallel side edge for providing a pair of channels for receiving a plurality of cards;

a resilient clip is secured to said rear of said wall;

an opening extends through said wall and around said resilient clip;

said opening exposes said clip from said base and from said pair of channels, said opening enables said clip to act as a spring for holding items located within said pair of channels or to act as a securing means for securing said base to a desirable structure;

said resilient clip extends upwardly through said opening and pass said front for providing said resilient clip to removably secure items slidably located within said pair of channels;

a first stop is oppositely located from a second stop and said first stop and said second stop prevent said plurality of cards from escaping said pair of channels;

said first stop is an elongated wall which extends upwardly from said front and entirely across said perpendicular edges; and said second stop is a curved flange extending outwardly and upwardly from said front and from a perpendicular edge of said perpendicular edges, opposite said first stop.

2. A multi-purpose holder device as in claim 1 wherein a clearance exists between said channel and said second stop.

3. A multi-purpose holder device as in claim 1 wherein said resilient clip includes gussets for added strength and structural integrity.

4. A multi-purpose holder device as in claim 1 wherein said resilient clip includes a tip, and said tip curves slightly downward and towards said rear of said base wall.

5. A multi-purpose holder device as in claim 4 wherein said resilient clip includes a highest point, said highest point is the start of a downward curve, and said highest point will be substantially parallel said pair of channels.

6. A multi-purpose holder device as in claim 1 wherein said wall, resilient clip and channels are an integral structure.

7. A multi-purpose holder device as in claim 1 wherein said wall, resilient clip, channels, said first stop, and said second stop are an integral structure.

8. A multi-purpose holder device comprising:

a rectangular base wall having a front, rear, a first side edge parallel to a second side edge, a top edge perpendicular to said first side edge and said second side edge, and a bottom edge parallel to said top edge and perpendicular to said first side edge and said second side edge;

a first channel extends upwardly and outwardly from said front and from first side edge and a second channel, parallel to said first channel, extends upwardly and outwardly from said front and said second side edge, said first channel and said second channel can receive a plurality of cards;

a resilient clip is secured to said rear of said wall;

an opening extends through said wall and around said resilient clip;

said opening exposes said clip from said base and from said pair of channels, said opening enables said clip to act as a spring for holding items located within said pair of channels or to act as a securing means for securing said base to a desirable structure;

said base wall, said first channel, said second channel and said resilient clip form an integral unit; and said resilient clip includes gussets for added strength and structural integrity.

9. A multi-purpose holder device as in claim 8 wherein said resilient clip extends upwardly through said opening and pass said front.

10. A multi-purpose holder device as in claim 8 wherein a first stop is oppositely located from a second stop and said first stop and said second stop prevent accidental removal from said first channel and said second channel.

11. A multi-purpose holder device as in claim 10 wherein said first stop is an elongated wall which extends upwardly from said front and entirely across said top edge.

12. A multi-purpose holder device as in claim 11 wherein said second stop means is a curved flange extending outwardly and upwardly from said front and from said bottom edge.

13. A multi-purpose holder device as in claim 8 wherein said resilient clip includes a tip, and said tip curves slightly downward and towards said rear of said base wall.

14. A multi-purpose holder device comprising:

a base wall having a front, rear, parallel side edges, and parallel perpendicular edges;

said perpendicular edges are perpendicular to said side edges;

a channel extends upwardly and outwardly from said front and from each parallel side edge for providing a pair of channels for receiving a plurality of cards, receiving said plurality of cards provides for said base wall to be oriented anteriorly;

said pair of channels each include a side wall extending anteriorly and upwardly from said parallel side edge;

said pair of channels include an uppermost channel and a lowermost channel when said base wall is oriented anteriorly;

a first stop is oppositely located from a second stop and said first stop and said second stop prevent said plurality of cards from escaping said pair of channels;

said first stop is an elongated wall which extends upwardly from a parallel perpendicular edge located at said front and entirely across said perpendicular edges located at said front;

said second stop is a curved flange extending outwardly and inwardly from said front of said side wall of said lowermost channel;

a clearance is located between said second stop and said base wall;

said clearance enables a user to push a preceding card for exposing a subsequent card;

said opening exposes said clip from said base and from said pair of channels, said opening enables said clip to act as a spring for holding items located within said pair of channels or to act as a securing means for securing said base to a desirable structure.

15. A multi-purpose holder device as in claim 1 wherein receiving said plurality of cards provides for said base wall to be oriented anteriorly, said pair of channels each include a side wall extending anteriorly and upwardly from said parallel side edge, said pair of channels include an uppermost channel and a lowermost channel when said base wall is oriented anteriorly, said second stop is a curved flange extending outwardly and inwardly from said front of said side wall of said lowermost channel, and a clearance is located between said second stop and said base wall.

16. A multi-purpose holder device as in claim 11 wherein receiving said plurality of cards provides for said base wall to be oriented anteriorly, said pair of channels each include a side wall extending anteriorly and upwardly from said parallel side edge, said pair of channels include an uppermost channel and a lowermost channel when said base wall is oriented anteriorly, said second stop is a curved flange extending outwardly and inwardly from said front of said side wall of said lowermost channel, and a clearance is located between said second stop and said base wall.

* * * * *